US007434440B2

(12) United States Patent
Fay

(10) Patent No.: US 7,434,440 B2
(45) Date of Patent: Oct. 14, 2008

(54) HEAVY-DUTY PEX CLAMP INSTALLATION TOOL

(75) Inventor: Robert F. Fay, York, PA (US)

(73) Assignee: Murray Corporation, Hunt Valley, MD (US)

( * ) Notice: Subject to any disclaimer, the term of this patent is extended or adjusted under 35 U.S.C. 154(b) by 233 days.

(21) Appl. No.: 11/407,584

(22) Filed: Apr. 20, 2006

(65) Prior Publication Data

US 2006/0236743 A1 Oct. 26, 2006

Related U.S. Application Data

(60) Provisional application No. 60/673,168, filed on Apr. 20, 2005.

(51) Int. Cl.
*B25B 5/08* (2006.01)
*B25B 5/12* (2006.01)
*B21D 39/04* (2006.01)

(52) U.S. Cl. ..... 72/409.1; 72/409.01; 72/398; 72/403; 72/452.8; 81/309; 29/243.56; 29/243.517

(58) Field of Classification Search ..... 72/409.01, 72/409.1, 396–398, 453.15, 453.16, 452.8, 72/452.9, 394, 403; 29/243.56, 243.517, 29/243.57, 268; 81/307, 309
See application file for complete search history.

(56) References Cited

U.S. PATENT DOCUMENTS

| | | | | |
|---|---|---|---|---|
| 1,105,191 | A | 7/1914 | Flora et al. | |
| 1,355,465 | A * | 10/1920 | Gibbons | 29/243.57 |
| 1,498,488 | A | 6/1924 | Stallings | |
| 1,653,340 | A | 12/1927 | Carolus | |
| 1,720,133 | A * | 7/1929 | Le Roy | 72/403 |
| 2,086,400 | A | 7/1937 | Brenizer | |
| 2,244,482 | A | 6/1941 | Baxter et al. | |
| 2,614,304 | A | 10/1952 | Oetiker | |
| 2,735,322 | A | 2/1956 | Meisler | |
| 2,747,446 | A | 5/1956 | Eder | |
| 2,861,490 | A * | 11/1958 | Rozmus | 72/399 |
| 2,910,900 | A | 11/1959 | Klein | |
| 3,216,291 | A | 11/1965 | Madeira | |
| 3,257,874 | A | 6/1966 | Madeira | |
| 3,345,856 | A | 10/1967 | Werner et al. | |

(Continued)

FOREIGN PATENT DOCUMENTS

| | | |
|---|---|---|
| DE | 32 47 073 C1 | 3/1984 |

(Continued)

*Primary Examiner*—Daniel C Crane
(74) *Attorney, Agent, or Firm*—Whiteford, Taylor & Preston LLP; Jeffrey C. Maynard

(57) ABSTRACT

A heavy-duty hose clamp installation tool is described. A pair of lever arms operates a pair of jaw members to engage a pinch clamp ear. The installation tool includes a pair of jaw members with clamp edges forming a lip for receiving the clamp ears. A pair of extension arms connects the jaw members to a pair of lever arms. The extension arms are pivotally interconnected intermediate the jaw member section so that closing the handle ends of the lever arms translates the jaw members towards a closed position thereof, thus squeezing the clamp ear. Once the ear of the clamp is crimped, an auxiliary form punch is used to flatten the ear, resulting in a tighter clamp configuration.

19 Claims, 11 Drawing Sheets

U.S. PATENT DOCUMENTS

| | | | | | |
|---|---|---|---|---|---|
| 3,402,436 | A | | 9/1968 | Oetiker | |
| 3,559,448 | A | * | 2/1971 | Illingworth | 72/409.06 |
| 3,688,553 | A | * | 9/1972 | Demler | 72/409.01 |
| 3,704,620 | A | | 12/1972 | Allen | |
| 3,706,219 | A | | 12/1972 | Hoffman et al. | |
| 4,492,004 | A | | 1/1985 | Oetiker | 24/20 R |
| 4,610,187 | A | | 9/1986 | Spaulding | |
| 4,633,558 | A | | 1/1987 | Spaulding | |
| 4,708,034 | A | | 11/1987 | Oetiker | |
| 4,724,729 | A | | 2/1988 | Oetiker | |
| 4,742,736 | A | | 5/1988 | Williams | |
| 4,751,862 | A | | 6/1988 | Winfrey | |
| 4,754,668 | A | | 7/1988 | Oetiker | |
| 4,884,432 | A | | 12/1989 | Watson | |
| 4,987,652 | A | | 1/1991 | Spaulding | |
| RE33,744 | E | | 11/1991 | Oetiker | 24/20 R |
| 5,070,580 | A | | 12/1991 | Oetiker | |
| 5,195,353 | A | | 3/1993 | Erbrick et al. | |
| 5,230,126 | A | | 7/1993 | Oetiker | 24/20 R |
| 5,282,295 | A | | 2/1994 | Oetiker | |
| 5,326,325 | A | | 7/1994 | Oetiker | 464/180 |
| 5,377,400 | A | | 1/1995 | Homm | |
| 5,410,903 | A | * | 5/1995 | Schneider | 72/399 |
| 5,669,113 | A | | 9/1997 | Fay | |
| 5,934,136 | A | | 8/1999 | Bracher et al. | |
| 6,036,569 | A | * | 3/2000 | Brown et al. | 445/66 |
| 6,044,686 | A | * | 4/2000 | Dischler | 72/402 |
| 6,226,874 | B1 | | 5/2001 | Jansson | |
| 6,516,523 | B1 | | 2/2003 | Lin | |
| 2003/0167881 | A1 | | 9/2003 | Chauffeteau et al. | |
| 2004/0255632 | A1 | | 12/2004 | Dole et al. | |

FOREIGN PATENT DOCUMENTS

| | | |
|---|---|---|
| DE | 36 17 834 A1 | 3/1987 |

* cited by examiner

PRIOR ART
WITHOUT DOWEL

PRIOR ART
SOLUTION

JAWS CLOSE
STAGE #1

RE-FORM EAR
STAGE #2

HEAVY-DUTY PEX CLAMP INSTALLATION TOOL

CROSS REFERENCE TO RELATED APPLICATION

This application is based upon and claims benefit of copending and co-owned U.S. Provisional Patent Application Ser. No. 60/673,168 entitled "Heavy-Duty PEX Installation Tools", filed with the U.S. Patent and Trademark Office on Apr. 20, 2005 by the inventor herein, the specification of which is incorporated herein by reference.

BACKGROUND OF THE INVENTION

1. Field of the Invention

The present invention relates generally to tools for use with clamps, and more particularly to a heavy-duty installation crimping tool for forming the "ears" commonly found on pinch-type clamps.

2. Background of the Prior Art

Clamps are available in a wide variety of configurations for meeting the requirements of particular applications. For example, hose clamps are commonly used for mounting hose ends on various objects, such as radiators, water pumps, heaters, etc. Plastic pipe is used in many plumbing applications and for irrigation applications.

Different types of clamps are available. U.S. Pat. No. 2,614,304, to Oetiker, discloses a clamp having outwardly-projecting, deformable ears to facilitate installation. Once the clamp is in place, the ears are squeezed together with a suitable tool such as a pair of pliers to hold the clamp in place and to prevent leakage from the hose or pipe. Clamp structures provided with so-called "Oetiker" ears have enjoyed enormous commercial success.

U.S. Pat. No. 3,402,436 discloses an ear stiffening rib that improves the ability of such clamps to carry load while at the same time eliminating the need for special crimp tools. An ear with the stiffening rib would form into an acceptable ovate shape as opposed to a much weaker dunce-cap form associated with the prior art.

U.S. Pat. No. 5,070,580 discloses an Externally Strengthened Ear. By placing a secondary and heavier gauge ear cap over the existing clamp ear and then crimping both parts in unison, the holding ability of the clamp is increased.

U.S. Pat. No. 5,282,295 discloses a more robust stiffening rib to improve upon the "ears" load bearing capacity.

U.S. Pat. No. 5,669,113 discloses an improvement for the clamp and illustrates that by forming lobes on the upper corners of the "ear" a secure purchase with the crimp tool jaw is created, thus effectively eliminating clamps damaged by faulty crimps (i.e. slippage of the jaw off the ear at installation).

All of these improvements were directed at improving the load bearing capacity of the ear. The need for increased load was market driven by such things as use on pressurized applications (versus non-pressure or very low pressure), use on hose/tube materials that are of increased hardness (i.e. underground sprinkler/irrigation systems), and use in the home construction market for PEX plumbing applications.

Current market applications are particularly challenging in that PEX tubing (per ASTM F 876-01) is very hard and rigid. PEX tubing can be used for both hot and cold water systems that may be at pressures of up to 100 psi for prolonged periods of time. Generally speaking, this market is a professional contractors market, however, it is expected that the market will expand into the home repair and do-it-yourself markets as well.

Ear type clamps rely upon pinching down of a portion of the clamp to close the diameter of the clamp. Such pinching action places the band portion of the clamp in tension causing the band to stretch lengthwise during the pinching process, and forms the ear into a more circular shape. Current versions of clamps are made of heavier gauge and wider materials than previously seen in the industry, but still have stiffening ribs in the ear portion to locally increase the stiffness, the load carrying ability, and to prevent vertical buckling or "dunce-capping" of the ear. The robust nature of the new clamp puts increased stress and strain on both the installation tools used and the operators installing such clamps.

There remains a need, then, for a robust device that can achieve the squeezing of a heavy gauge clamp. There remains a need for a tool that can provide sufficient force to crimp the ears on a clamp without requiring extra human effort. Moreover, there remains a need for a tool that can squeeze the clamp and re-flatten the ear after squeezing.

The present invention addresses these problems encountered in installing such clamps. Heretofore there has not been a clamp installation tool with the advantages and features of the present invention. These improvements result in a significant increase in load bearing capacity of the "ears", resistance to tube pull-off type loading, increased ability to create a seal between clamped components, and decreased operator effort.

SUMMARY OF THE INVENTION

The present invention is concerned with the ergonomics of a new tool as well as the degree of tightness achieved by pinch-type (PEX) clamps in the field.

Throughout the history of pinch clamp usage, operators often wondered just how tight is the clamp being installed and is it tight enough for the specific application. An installed pinch clamp should provide a sufficient seal such that, pull-off resistance of the clamp is sufficiently high to cause the tube to fail mid-length while the clamped end remains attached to its fitting, without drifting from its original position. Once the clamp is put on and the installation tool is removed, the ear opens slightly due to natural spring-back of the clamp material, due to the tensile load stored in the band, and due to energy stored in the compressed tubing. The general guideline offered to the concerned public is that the "ear will spring open slightly" after installation and for general purposes a visible gap at the root of the pinched ear will be around 1/32". The problem comes about by the fact that many operators are not capable of determining the gap size with any degree of precision and/or consistency. In order to provide a pinch clamp with tighter seal of heavier gauge material, a more robust, heavy-duty tool is needed to install the clamp successfully. Additionally, over repeated installations the pivot points of existing installation tools wear, the wear being compounded by the higher forces needed for heavy duty PEX clamp. As this wear occurs gradually with time, it is not readily apparent to the operator. Eventually, worn-out tools are inadvertently used to make clamp installations resulting in large gaps that do not meet the standard of what the clamping system can tolerate. The consequence is failed connections and leaking water supply systems.

It has been learned that the tighter the ear remains, the higher the tube pull-off resistance, and the better the resultant seal. One approach to creating a tighter clamp is to use heavier gauge material. However, a difficulty with using heavier gauge material and trying to obtain a tighter seal is that present installation tools cannot withstand the demand of the workload. Of particular concern is the amount of grip strength required to successfully close a tool. While the effort is high at normal room temperatures, the effort required grows in magnitude at a cold work site or for test assemblies prepared at cold temperatures.

Such activity requiring large human effort will result in:

1. operator injuries and/or medical claims
2. mis-aligned, side-loaded, or otherwise damaged clamps
3. premature tool failure or wear beyond the anticipated service limit.

In testing of prior art tools (FIG. 1), an operator was required to 109 pounds of gripping type force in order to fully crimp a 1" PEX clamp. Despite the fact that two hands may be used on a prior art tool, the effort is too extreme for most people to manage safely. In addition, the span or angle of the two levers when jaws first make contact with a clamp is too large (10½") for most people and well beyond industry recommendations of 3½" max. In contrast, the present invention has greatly reduced the operator effort to a comfortable 37 pounds and the mechanical advantage offered by the toggle arrangement allows this effort to drop off to nearly zero at the completion of the squeezing cycle.

It has been determined, through experimentation, that two stage forming of the ear results in a better seal; the first stage being squeezing the ear, the second stage being re-flattening the ear. The re-flattening of the ear tends to cause the clamp to retain its sealed position better.

FIGS. 2*a-d* illustrate the history of the problem and attempted solutions associated with ear style clamps. In FIG. 2*a*, an un-ribbed ear clamp is pinched by a standard tool resulting in a weak dunce-cap shaped ear form, leaving a gap of dimension "a". In FIG. 2*b*, an un-ribbed clamp is installed with a prior art tool having a flat insert to limit the ear deformation, which yields an ear form that is stiffer and of lower profile having a gap of dimension "b". FIG. 2*c* shows an improved ribbed-ear clamp installed with a standard prior art tool, illustrating that the flat tool insert is not needed if a ribbed-ear type clamp is used. The resulting profile is low and has a gap of dimension "c". FIG. 2*d* illustrates an improved ribbed-ear clamp installed with the tool of the present invention using a two-step pinching and reforming process. The resulting clamp has a low profile and leaves a gap of dimension "d". In all cases, gap "d" is smaller than gap "c", which is smaller than gap "b", which, in turn, is smaller than gap "a". This demonstrates that the ear reforming process creates the tightest seal.

An objective of the present invention is to do away with the subjective ear root gap size concern by providing a robust tool that allows the operator to visually see that the ear root gap has been diminished to zero (i.e. the clamp is fully closed) while the clamp is in the process of being crimped and then re-forms the bulging (ovate) shaped ear into a much stiffer and stronger geometry. By re-forming the ear in such a two-stage manner the spring-back (or opening) of a pinched ear is virtually eliminated. The minor gap that ultimately results is generally less than 0.010 inches and usually appears to a layperson as if there is no gap at all.

In testing, PEX clamps installed with standard prior art tools offer a measured ear root gap of greater than 1 mm (0.040 inch). In Pull-Off tests of ⅝", ¾", and 1" PEX assemblies it was found that the tubes would pull off the fittings. Whereas the same type clamps assembled with a tool of the present invention were tight enough to retain the tubes on the fittings with failure occurring in the length of tube between the fittings.

It is, therefore, an object of the present invention to provide a pinch-type clamp installation tool that avoids the disadvantages of the prior art.

Another object of the present invention is to provide an installation tool with large handgrips to move the major load to the operator's pectoral muscles. A related object of the present invention is to increase the lever arms and handle length to reduce installation effort.

Another objective of the present invention is to move away from a tool design that requires the operators to have a high degree of handgrip strength. History has shown that repetitive work activity, especially those requiring a high level of grip type exertion, have a tendency to develop medical complications such as carpal-tunnel syndrome. By eliminating the grip style levers in favor of two power grips, strain is taken off the muscles involved with grip strength and transferred to the larger and stronger pectoral group of the chest.

Another object is to enable an installation tool that is fully field strippable for oiling, cleaning, inspection, and part replacement. Another objective of the present invention is to provide an easy method for in-the-field adjustment of the tool jaw spacing such that an operator can restore a well-used tool to factory new performance levels with little effort or required skill. This is accomplished by providing the present invention with split bearing blocks, on either side of the main jaws, that are cross-bolted together and which have a stack of shims between the bearing blocks. In this simple manner, an operator observing that the ear roots do not touch during installation may remove one or more shims from both the left and right side bearing block assemblies to adjust for the observed wear.

Another objective of the present invention is to improve the means by which the main jaws are synchronized during their opening and closing movements. Prior art uses a length of dowel pin, free floating in matched semi-circular cutouts on each jaw. In combination, the three components form a simple yet effective gear train, with both jaws moving in unison and counter-rotating directions (see FIGS. 7 and 8). Inasmuch as it is an objective of this invention to have a moveable auxiliary punch between the two main jaws, a length of dowel pin cannot be used. Instead, two disc-shaped synchronizers create a portal between the jaws and the discs, such that the auxiliary punch may pass through.

It is another object of the present invention to provide an installation tool that has two stage forming of the clamp ear. A related object is to provide an installation tool that squeezes the clamp ear in a first stage and then re-flattens the clamp ear in a second stage.

Another objective of the present invention is to provide for single stage forming by way of a fixed position auxiliary punch. While testing has shown that this type of forming cannot deliver the extreme tightness found in dual stage forming, it nonetheless has economic advantages to many markets where the extreme tightness and robust clamp strength may not be required, such as irrigation and sprinkler systems. Here the operator would benefit by way of crimps that are tighter than prior art tools, improved ergonomics by way of reduced effort, a visual sighting of tool wear, and an improved method of in-field wear adjustment.

Yet another objective of the present invention is to enable the combination of a tool head as described above albeit actuated by means other than human strength and levers. Actuation could be by way of a drill motor with an integral torque-link that would then allow the crimping of an "ear" clamp with need of a single hand only. Likewise, an arrangement of hydraulic and/or pneumatic cylinders or actuators could be used for the initial force input to such a tool head.

In accordance with the above objects, a clamp installation tool is provided for squeezing the ears of a pinch-type clamp. A pair of lever arms operates a pair of jaw members to engage a pinch ear. Once the ear of the clamp is crimped, an auxiliary form punch is used to flatten the ear, resulting in a tighter installed clamp configuration. The installation tool includes a pair of jaw members with clamp edges forming a lip for receiving the clamp ears. A pair of extension arms connects the jaw members to a pair of lever arms. The extension arms are pivotally interconnected intermediate the jaw member section so that closing the handle ends of the lever arms translates the jaw members towards a closed position thereof, thus squeezing the clamp ear.

Other objects and advantages of this invention will become apparent from the following description taken in conjunction with the accompanying drawings wherein are set forth, by way of illustration and example, certain embodiments of this invention. The various features of novelty that characterize the invention will be pointed out with particularity in the claims of this application.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF EXEMPLARY EMBODIMENTS

The invention summarized above and defined by the enumerated claims may be better understood by referring to the following description, which should be read in conjunction with the accompanying drawings in which like reference numbers are used for like parts. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 4:
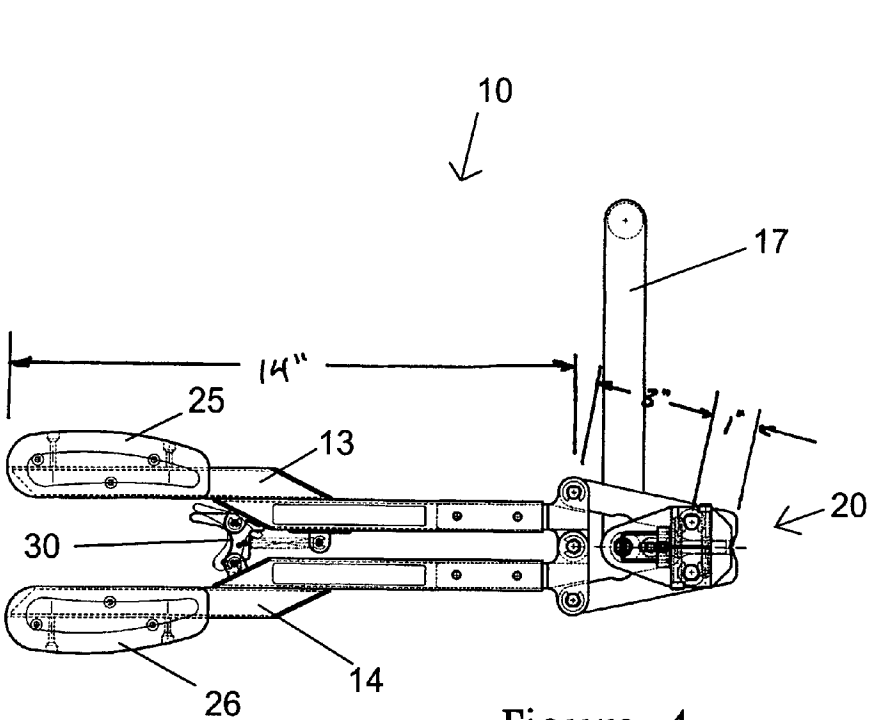
FIG. 4 shows a plan view of the installation tool of FIG. 3 in a closed position.
Figure 3:
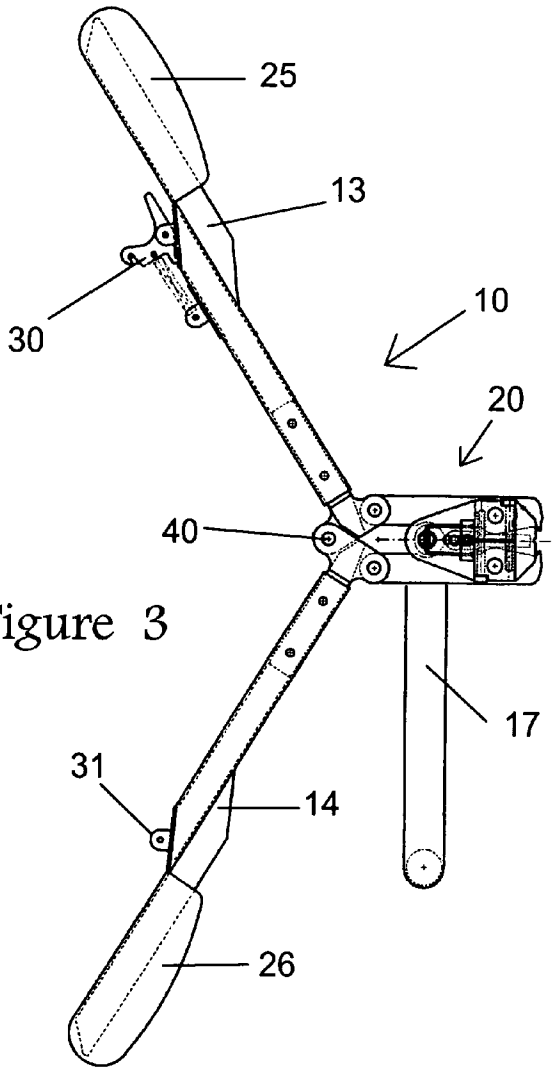
FIG. 3 shows a plan view of an installation tool in an open position according to one embodiment of the present invention.

Referring to the drawings, FIGS. 3 and 4 show a tool, indicated generally as 10, according to a first embodiment of the present invention. FIG. 3 shows tool 10 in an open position and FIG. 4 shows tool 10 in a closed position. Tool 10 comprises a pair of lever arms 13, 14 and rotatable arm 17. Lever arms 13, 14 are attached to head 20, shown in more detail in FIG. 5. The distal ends of lever arms 13, 14 are provided with handle forming extensions 25, 26, that may be offset from the centerline of lever arms 13, 14 to enable sufficient room for an operator's hands during use. The handle forming extensions 25, 26 are of generous proportion and sculpted to fit the hand without pressure points. Tool 10 is also provided a spring-loaded releasable latching mechanism 30 that snaps into a mating pin bracket 31 when the tool 10 is fully closed, and will hold the lever arms 13, 14 in the closed position. An operator can selectively release the latching mechanism 30 following operation of the tool 10.

Figure 5:
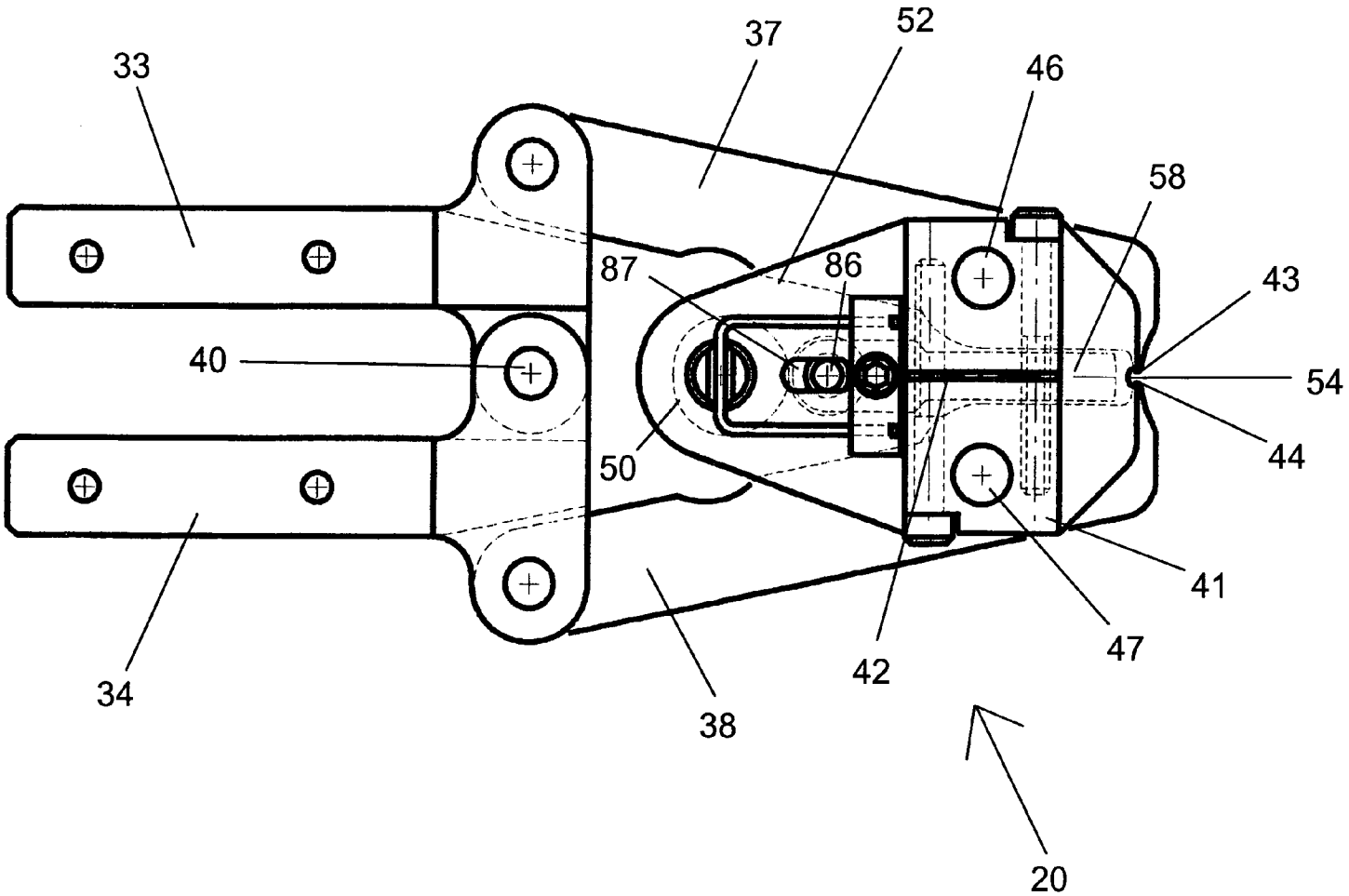
FIG. 5 shows an enlarged view of the head of the installation tool of FIG. 3.

As shown in FIG. 5, head 20 comprises extension arms 33, 34 and jaw members 37, 38 having oppositely facing clamp edges 43, 44. The proximal end of extension arm 33, 34 are T-shaped, having an opening for a pivot point on each end of such T. The inner point of the T for each extension arm 33, 34 is joined to each other at toggle point 40. The outer point of the T for each extension arm 33, 34 is pivotally attached to jaw members 37, 38, respectively, by means of pivot pins and snap rings. The spacing between jaw members 37, 38 is maintained by the center-to-center distance established by cross-bolted bearing blocks 41 and a stack of shims 42, which shims 42 are intended to be removed systematically as wear to the pivotal joints occur with extended tool use, thus restoring the jaw spacing to the optimal. Jaw members 37, 38 pivot about pivot pins 46, 47, respectively. By moving lever arms 13, 14 outward causes extension arms 33, 34 to pivot around toggle point 40, drawing the attached end of jaw members 37, 38 inward, resulting in opening of the clamp edges 43, 44. In a preferred embodiment, clamp edges 43, 44 should be able to open at least approximately 0.5 inches. By moving lever arms 13, 14 inward causes extension arms 33, 34 to pivot around toggle point 40, drawing the attached end of jaw members 37, 38 outward, resulting in closing of the clamp edges 43, 44. In a preferred embodiment, clamp edges 43, 44 should be able to close to within at least approximately 0.07 inches. When tool 10 is closed such that the clamp edges 43, 44 are sufficiently close, latching mechanism 30 will latch to hold the lever arms 13, 14 in the closed position.

Side plates 52, 53 (not shown) hold the jaw members 37, 38 such that the toggle pivots align to a common plane for maximum mechanical advantage. Portal cutouts, such as 54, are made in both side plates 52, 53 (not shown) to facilitate the visual inspection of a clamp being installed for full clamp closure. Note that tool wear will start to show up at this location with a gradual widening of the ear roots.

Figure 6:
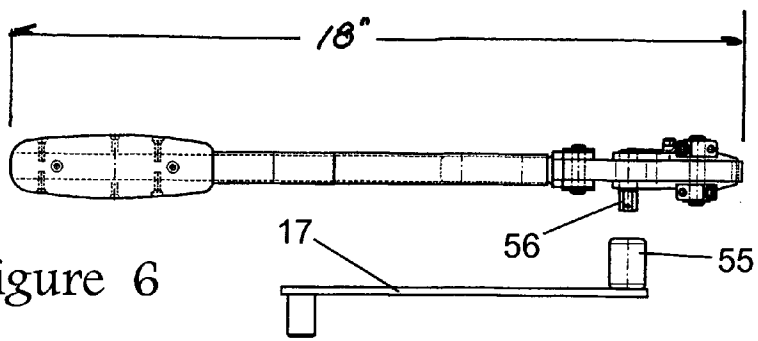
FIG. 6 shows a side view of the installation tool of FIG. 3 with an auxiliary tool lever aligned with a matching drive unit.

Referring to FIG. 6, a rotatable arm 17 is provided with a socket 55 that matches to drive 56 on the tool 10. Such socket 55 and drive 56 may be hex-shaped, square-shaped, or some other appropriate matching socket and drive combination. The drive 56 is attached to a cam 50. When the socket 55 is attached to drive 56 and the rotatable arm 17 makes a 180° rotation, cam 50 rotates to force auxiliary form punch 58 toward the clamping end of the tool 10. Cam 50 is pivotally mounted and free floating between side plates 52, 53 (not shown). In some embodiments, a detent can be provided to keep rotatable arm 17 and form punch 58 in a full up or full down position, as desired.

Figure 7:
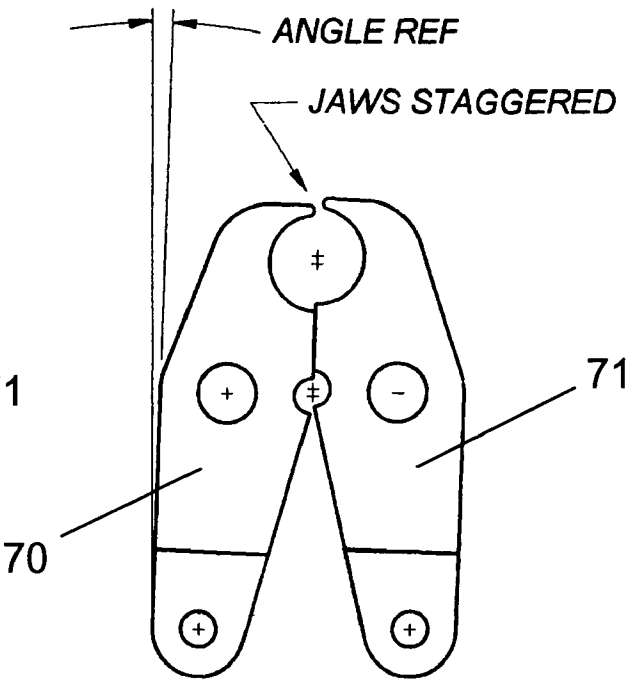
FIG. 7 shows a prior art configuration of the head of an installation tool.
Figure 8:
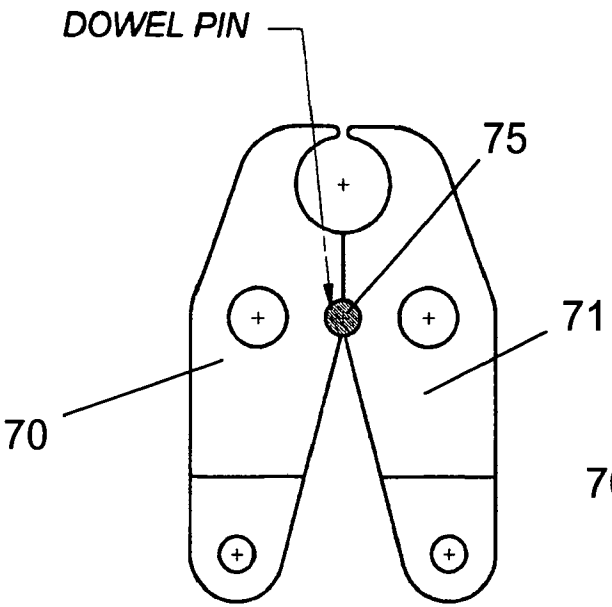
FIG. 8 illustrates a prior art solution.

FIGS. 7 and 8 show a pivot arrangement of the prior art. Tools that use a toggle mechanism to develop large forces usually synchronize the action of the jaws 70, 71 with a dowel pin 75 free floating in semi circular cutouts located between the jaws 70, 71. This allows the jaws to move in unison thus preventing a staggered jaw condition if the feature were to be omitted. FIG. 7 illustrates the misalignment resulting from removal of dowel pin 75. Since the present invention passes the auxiliary form punch 58 through the space between the jaws, a dowel pin cannot be used.

Figure 9:
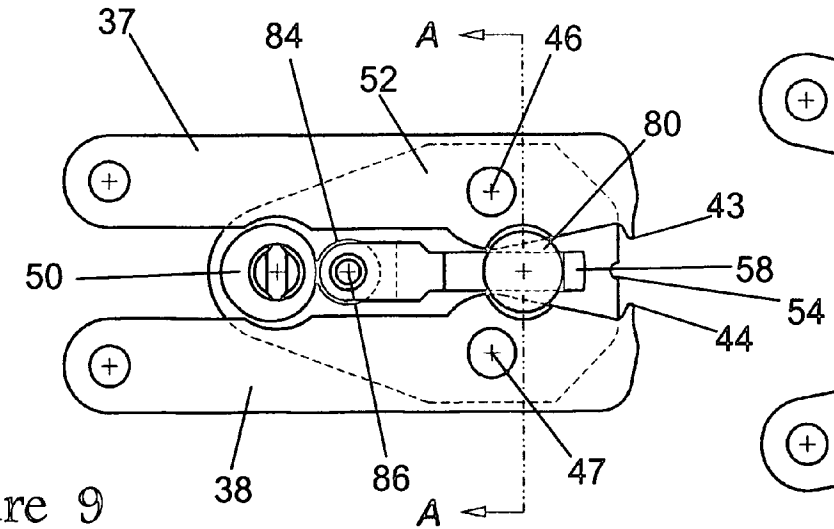
FIG. 9 shows an enlarged view of the head of an installation tool in an open position according to an embodiment of the present invention.
Figure 10:
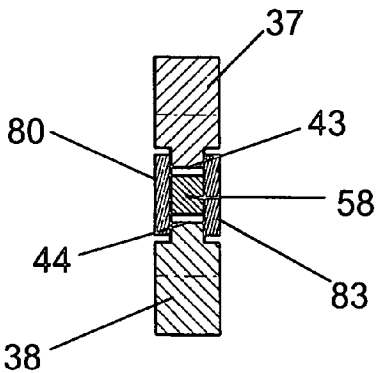
FIG. 10 shows a cross section of the head of FIG. 9, taken along the line A-A.

The auxiliary punch 58 is free floating in the space between the two jaw members 37, 38 and two floating disc synchronizers 80, 83. FIGS. 9 and 10 illustrate an embodiment of the present invention using two floating disc synchronizers 80, 83 to synchronize the jaws 37, 38. The floating discs 80, 83 are held between side plates 52, 53 (not shown) and provide an opening through which the auxiliary form punch 58 can pass. The disc-synchronizers 80, 83 are free floating in slightly oversized clearance pockets machined into the main jaw members 37, 38. Clearance cuts made into the two jaw members 37, 38 should be deep enough such that the discs 80, 83 will not bind with the jaws, nor will the punch 58 bind with the jaws.

Figure 11:
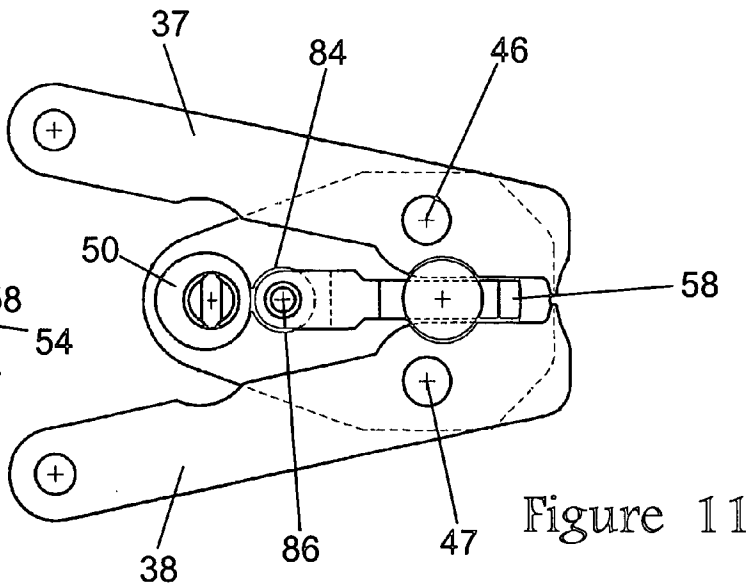
FIG. 11 shows the head of an installation tool of FIG. 9 in a closed position, with the auxiliary punch retracted.

FIG. 11 shows the arrangement of the main jaw members 37, 38 pivotally mounted to side plates 52, 53 (not shown) by way of pivot pins 46, 47 and snap rings (not shown). The auxiliary punch 58 is equipped with a cam roller 84 that is free spinning on axle 86, which rides in slot 87 (FIG. 5) cut through side plates 52, 53 (not shown) to provide centering of the auxiliary punch 58 within the space provided between the main jaw members 37, 38. In FIG. 11, the auxiliary punch 58 is in the retracted position.

Figure 12:
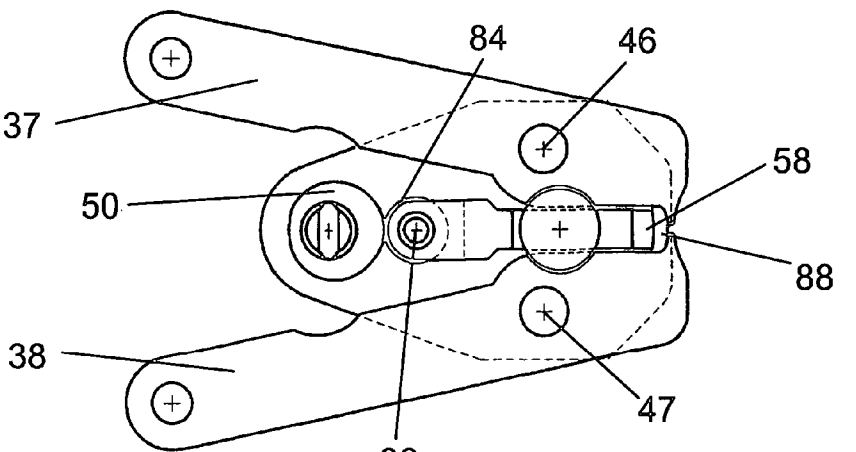
FIG. 12 shows the head of an installation tool of FIG. 9 in a closed position, with the auxiliary punch extended.

FIG. 12 shows the arrangement of the main jaw members 37, 38 with the auxiliary cam 50 rotated through 180 degrees to extend the auxiliary punch 58, which reforms the ovated ear pinched between main jaw members 37, 38 at the location indicated at 88.

In use, lever arms 13, 14 are moved to the open position and head 20 is placed over a clamp ear such that clamp edges 43, 44 are inserted between the lobes and the outer band end portions of the clamp ring with clamp edges 43, 44 engaging the sidewall of the ear of the clamp ring. Rotatable arm 17 should be positioned such that the auxiliary form punch 58 is in the retracted position. The lever arms 13, 14 are then moved to the closed position until the latch mechanism 30 latches. While the maximum load is being applied to the clamp, the operator perceives a drop-off in effort. Portal cutouts 54 may be provided in the side plates 52, 53 (not shown), so that the operator can visually witness full closure of the ear. With the lever arms latched in the closed position, rotatable arm 17 is rotated to cause the auxiliary form punch 58 to extend and flatten the ear of the clamp. The tool 10 can then be removed by releasing latch mechanism 30 and moving lever arms 13, 14 to the open position.

Figure 1:
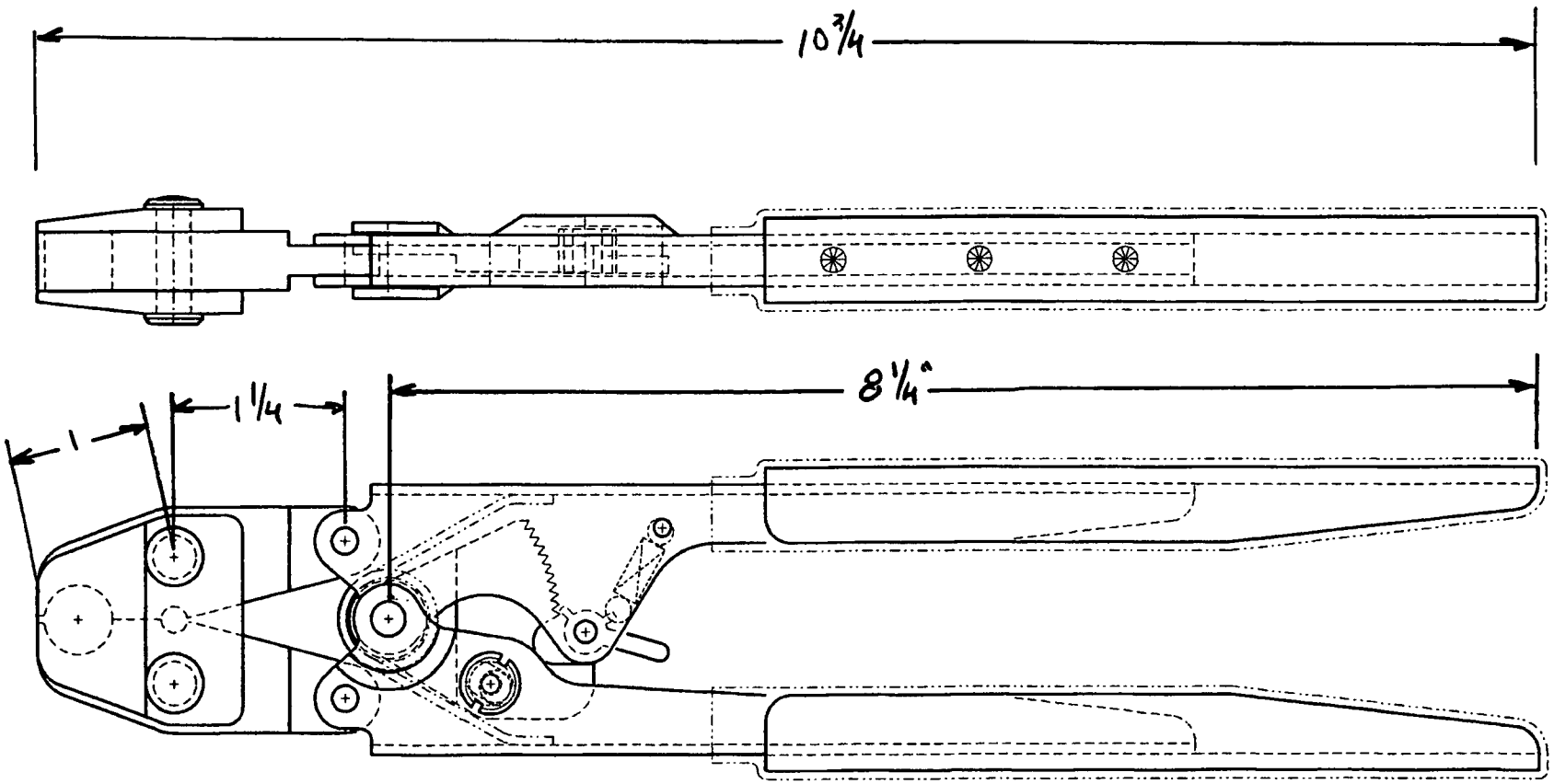
PRIOR ART Figure 1
FIG. 1 shows a side view and plan view of a prior art installation tool.
Figure 2A:
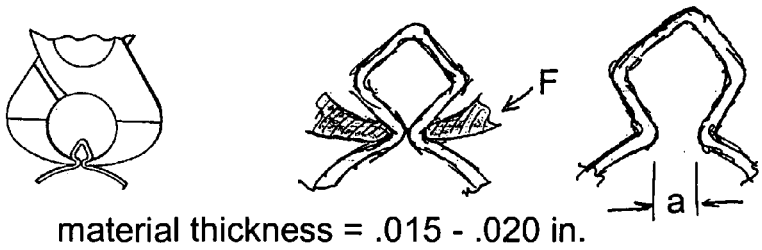
FIGS. 2*a-d* shows crimp "ear" forming using prior art tools and the present invention.
Figure 2B:
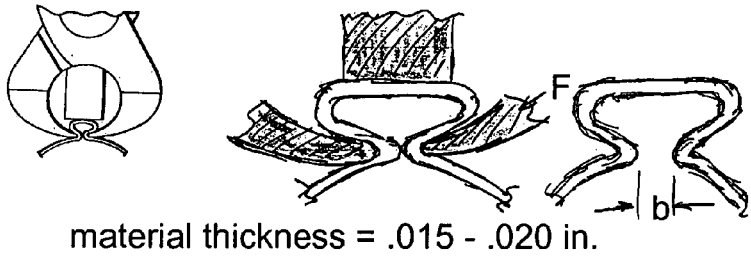
Figure 2C:
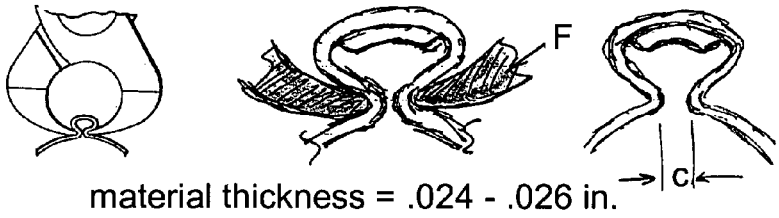
Figure 2D:
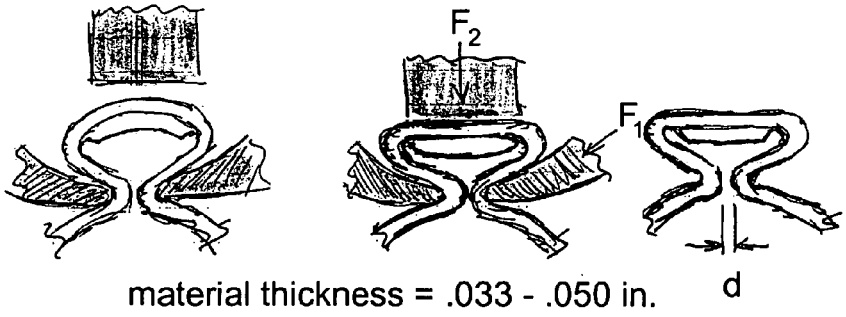

Tool 10 is longer in both the lever arm length and jaw length than the instrument illustrated in FIG. 1 thereby providing more mechanical advantage. The more robust tool provided by the present invention enables operation with clamps of higher thickness and provides a tighter seal.

Figure 13:
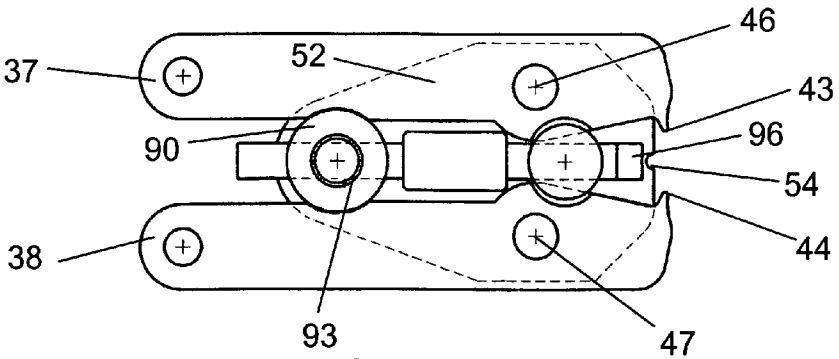
FIG. 13 shows the head of an installation tool in an open position according to another embodiment of the present invention.
Figure 14:
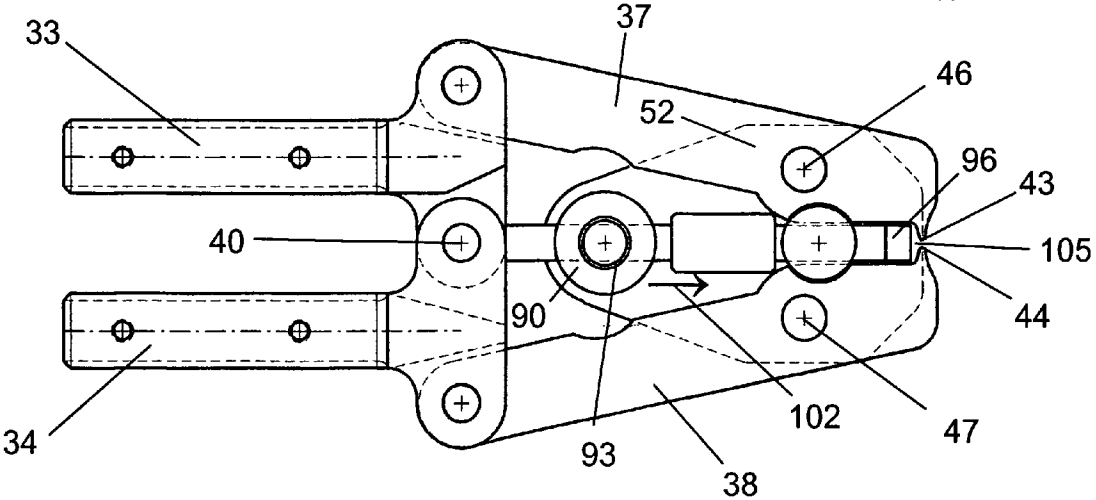
FIG. 14 shows the head of an installation tool of FIG. 13 in a closed position, with the optional punch extended.
Figure 15:
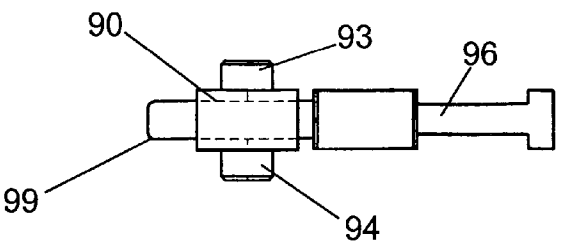
FIG. 15 shows an optional punch according to a second embodiment of the present invention.

FIGS. 13 and 14 show an alternate embodiment of the present invention. The cam configuration is replaced with guide bushing 90 that is pivotally mounted on bosses 93, 94, which are turned on either end of the guide bushing 90. The bosses 93, 94 engage the two side plates 52, 53 (not shown). Optional form punch 96 is aligned through the guide bushing 90 such that a free end 99 comes in contact with the toggle joint 40. FIG. 14 illustrates the benefit of this embodiment in that as the tool 10 is closed, the toggle joint 40 will align as illustrated and will move the optional form punch 96 in the direction indicated by arrow 102, to re-form the ovated ear of a clamp pinched between the clamp edges 43, 44 of the two main jaw members 37, 38 at the location indicated 105. With a toggle arrangement as shown, there is nearly no operator effort required to close tool lever arms 13, 14 through the last 5 degrees of rotation and just prior to latch 30 engaging in the closed position. This decrease in effort affords the opportunity to redirect the operator's strength and the combined leverage of tool 10 to raise the optional form punch 96 for useful work, and thereby eliminating the extra motion needed to crank the rotatable arm 17 through its required arc. FIG. 15 shows a side view of the guide bushing 90, bosses 93, 94, and optional form punch 96.

Figure 16:
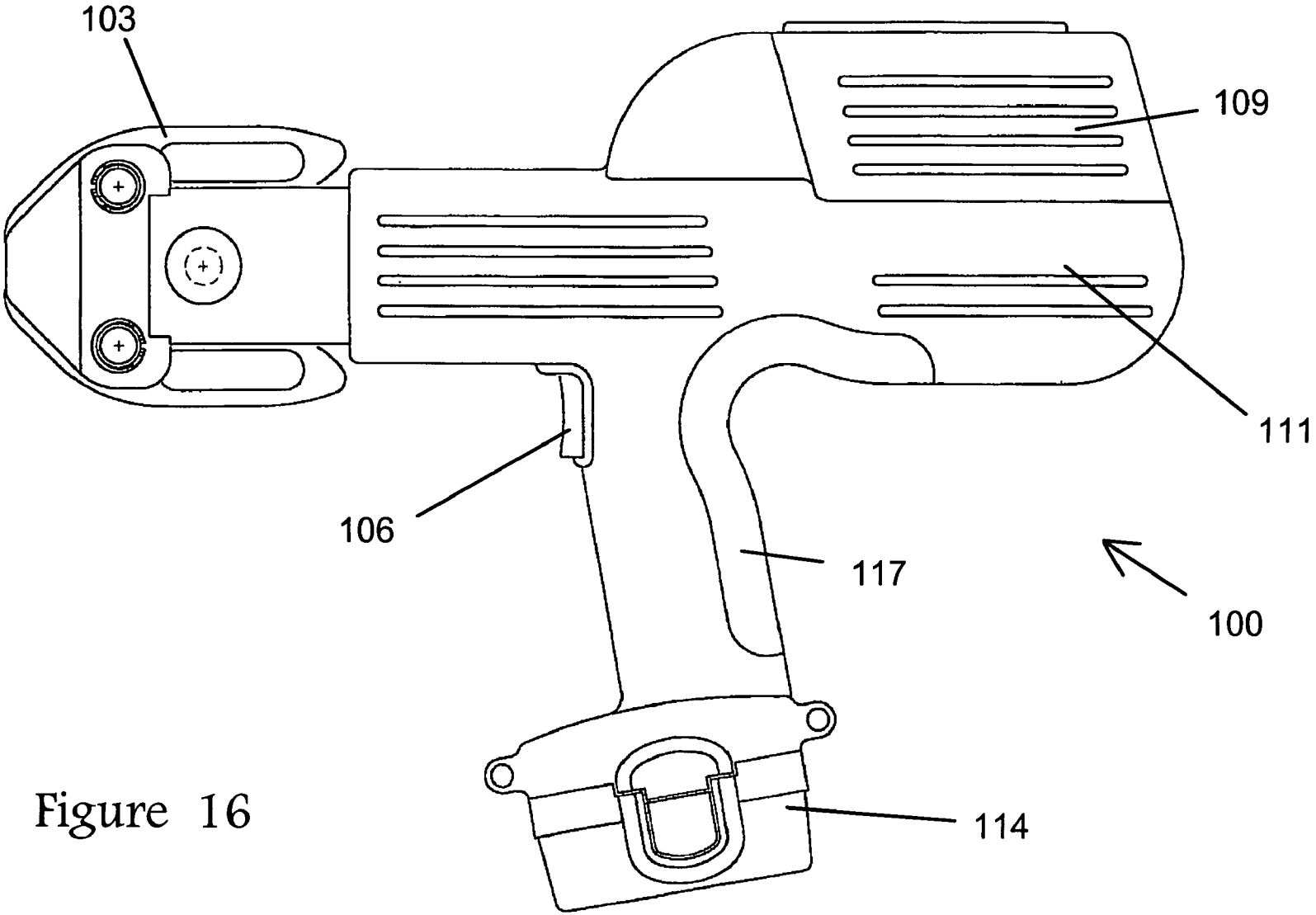
FIG. 16 shows a powered installation tool according to another embodiment of the present invention.

FIG. 16 illustrates a powered version, indicated generally as 100, of the installation tool according to the present invention. In the illustrated example, a power head 103 is installed on a Ridgid® Compact 100-B power tool. The power tool 100 is a lightweight, cordless, battery powered, hydraulic ram with rapid reverse. Tool 100 includes an operating switch 106 that, when depressed causes an internal electric motor 109 to power a hydraulic pump 111. The motor 109 is powered by a suitable battery 114, mounted in a handle 117 comprising part of the tool 100. In a preferred embodiment, the battery 114 is a Nickel-Metal Hydride rechargeable battery or a Nickel-Cadmium rechargeable battery. Other types of batteries can be used. The operating switch 106 controls power to the motor 109. The battery 114 is connected to the motor 109 by suitable wires through the switch 106. The hydraulic pump 111 forces fluid into an internal cylinder of the tool 100, forcing a ram 120 outward and applying thousands of pounds of pressing force onto the power head 103. The entire cycle duration is approximately seven (7) seconds. Once the cycle begins to deform a clamp, it will automatically continue until completion. When used with appropriate power head 103, the tool 100 is designed to mechanically press fittings onto tubing in order to create a tight and permanent seal.

Figure 17A:
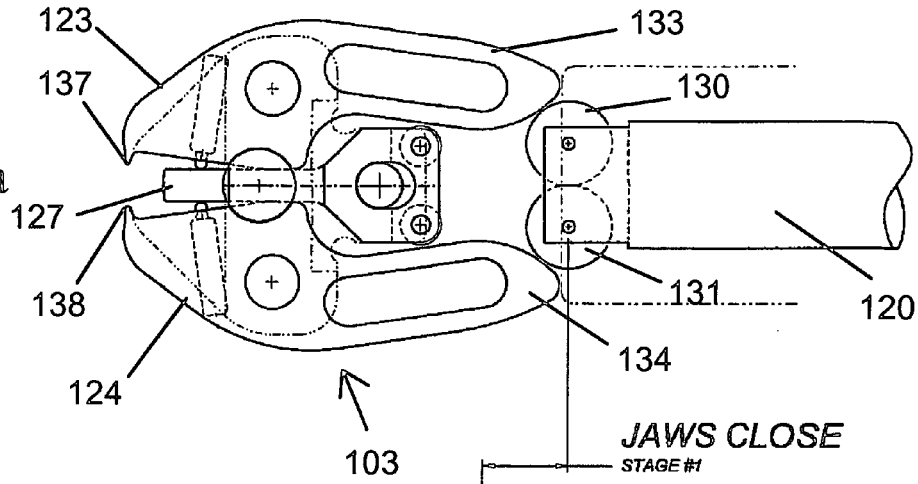
FIGS. 17*a-c* show the head of the installation tool of FIG. 16 in open and closed configurations.
Figure 17B:
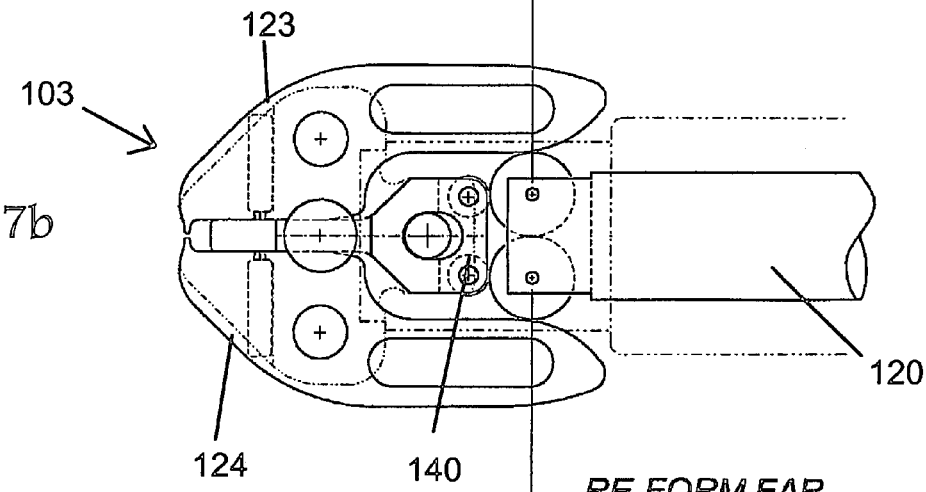
Figure 17C:
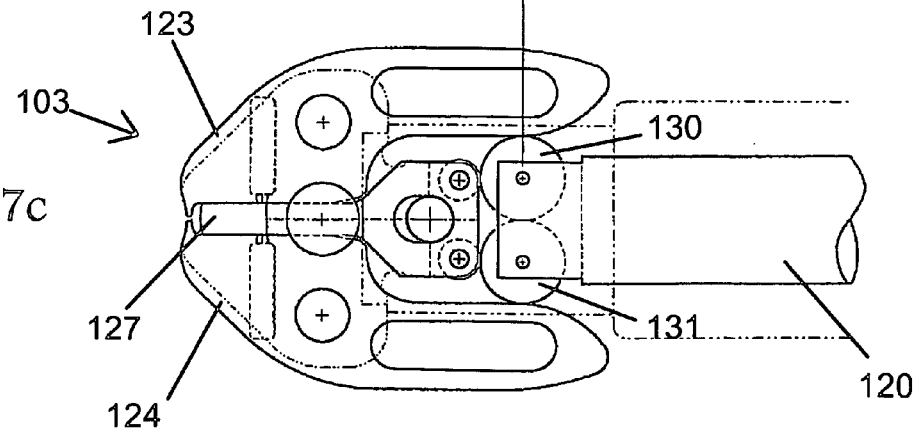

FIGS. 17*a-c* illustrate cross sections of the power head 103. The power head comprises jaw members 123, 124, and a reforming plunger 127. The hydraulic ram 120 includes two rollers 130, 131. As the hydraulic ram 120 extends outward (from right to left in the drawings), the rollers 130, 131 spread the back ends 133, 134 of jaw members 123, 124 apart causing the clamp edges 137, 138 to crimp on a clamp. FIG. 17*b* shows the power head 103 in the first stage with the jaw members 123, 124 closed. To complete the two-stage reforming process, the hydraulic ram 120 continues to extend so that the rollers 130, 131 push against the end block 140 of the reforming plunger 127. FIG. 17*c* shows the power head 103 at the end of the second stage re-forming of the ear. Note that second stage forming occurs when the rollers 130, 131 are on the flat or dwell portion of the jaws cam surfaces. By timing in this manner the jaw members 123, 124 are essentially finished with crimping the ear (i.e. stationary), so that all of the force of the ram 120 is directed toward the ear re-forming stage.

Figure 18A:
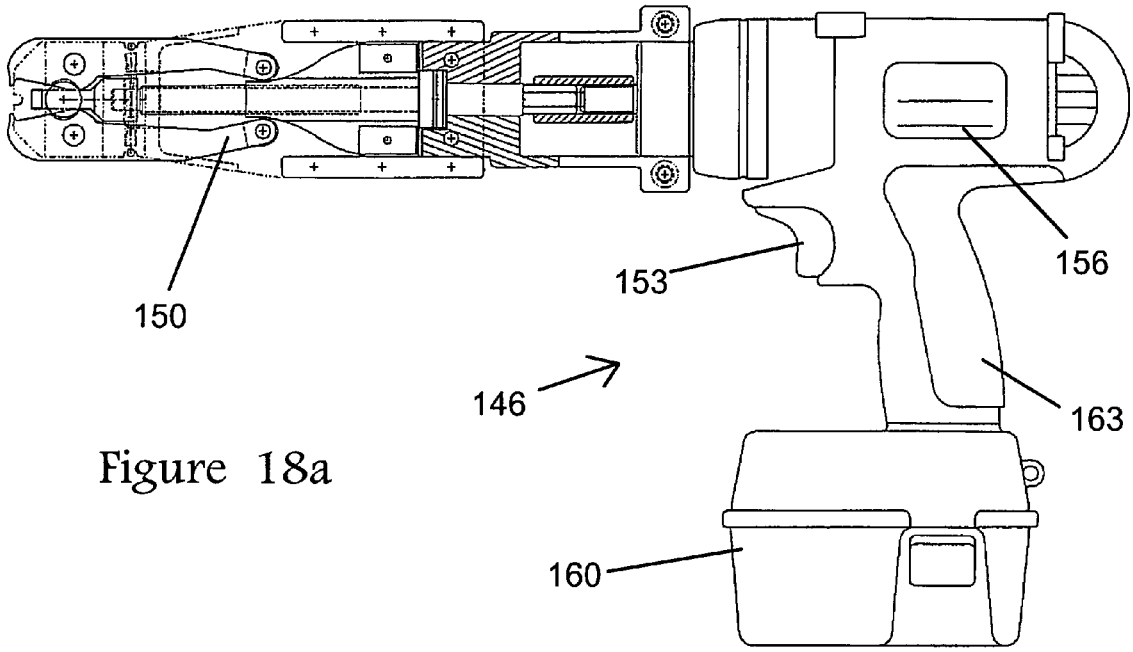
FIGS. 18*a-b* show a powered installation tool according to another embodiment of the present invention.
Figure 18B:
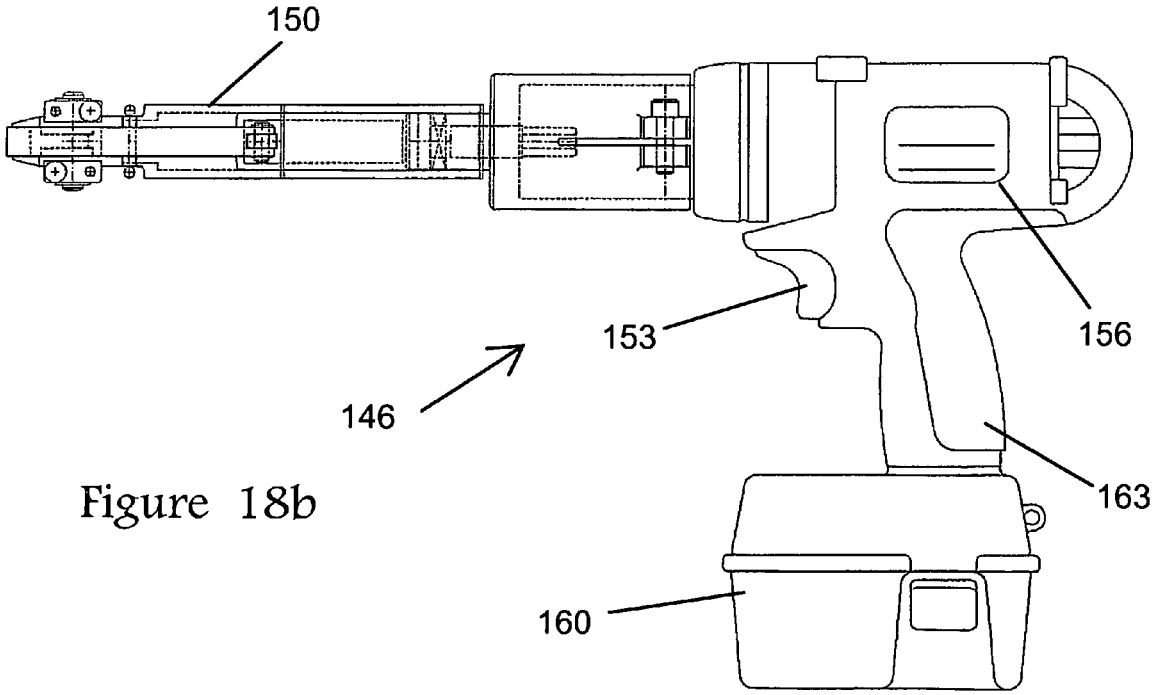

FIGS. 18*a* and *b* illustrate another embodiment of the powered tool, indicated generally as 146, that works with a commercially available drill motor. In the illustrated example, a power head 150 is installed on a DeWalt® 14.4 volt Model DW983K-2. The power tool 146 is a lightweight, cordless, battery powered, ½-inch heavy-duty cordless driver/drill with adjustable clutch. Other makes are also suitable. Tool 146 includes an operating switch 153 that, when depressed causes an internal fan-cooled motor 156 to rotate. The motor 156 is powered by a suitable battery 160, mounted in a handle 163 comprising part of the tool 146. In a preferred embodiment, the battery 160 is a Nickel-Metal Hydride rechargeable battery or a Nickel-Cadmium rechargeable battery. Other types of batteries can be used. The operating switch 153 controls power to the motor 156. The battery 160 is connected to the motor 156 by suitable wires through the switch 153. FIG. 18*b* shows the same tool head 150 rotated about the input axis for ease of use by an installer/plumber.

Figure 19C:
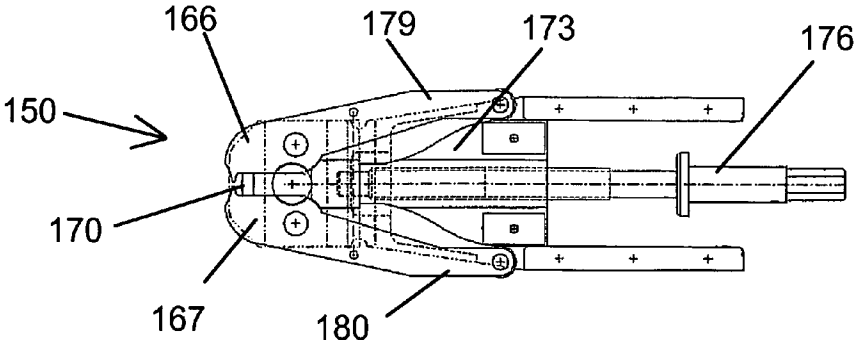
FIGS. 19*a-c* show the head of the installation tool of FIGS. 18*a* and *b* in open and closed configurations.
Figure 19B:
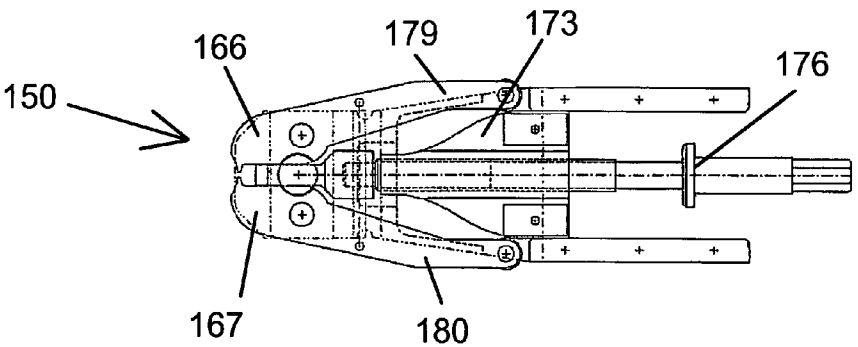
Figure 19A:
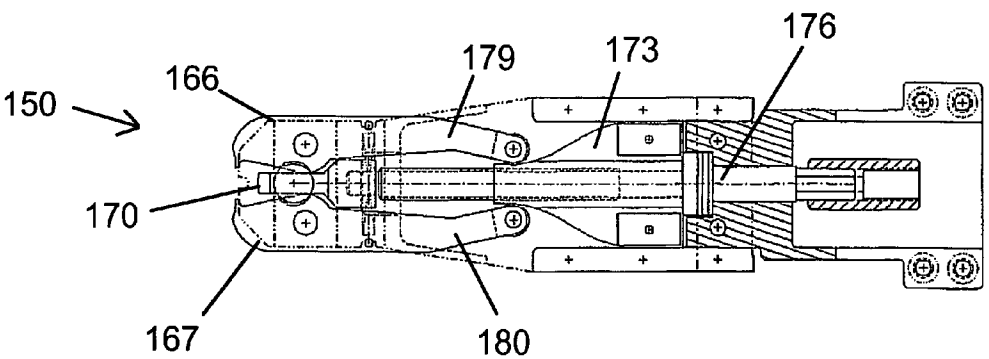

FIGS. 19*a-c* illustrate cross sections of the power head 150. The power head comprises jaw members 166, 167, and a reforming plunger 170. This tool head functions in the same manner as the one described with reference to FIGS. 16 and 17 except that it is actuated by rotary motion. A cam spade 173 is mounted on a jackscrew 176. As the drill motor 156 rotates the jackscrew 176, the cam spade 173 extends outward and causes the extension ends 179, 180 of the jaw members 166, 167 to spread open causing the jaw members 166, 167 to crimp on a clamp. FIG. 19*b* shows the power head 150 in the first stage with the jaw members 166, 167 closed. To complete the two-stage reforming process, the cam spade 173 continues to extend so that the reforming plunger 170 can reshape the ear. FIG. 19*c* shows the power head 150 at the end of the second stage reforming of the ear.

In a preferred embodiment, the drill motor would one be of the types having an adjustable slip such that the operator can sense the end of travel of the spade cam 173. Tool reset would be accomplished by putting the drill motor in reverse and backing off until the jaw members 166, 167 are wide enough to accept another fresh clamp, or full mechanical return is reached, in which case the clutch would trip out again.

The invention has been described with references to exemplary embodiments. While specific values, relationships, materials and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention as broadly described. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments herein shown and described will obviously occur to those skilled in the art upon becoming familiar with such underlying concept. It should be understood, therefore, that the invention may be practiced otherwise than as specifically set forth herein. Consequently, the present embodiments are to be considered in all respects as illustrative and not restrictive.

What is claimed is:

1. A clamp installation tool, comprising:

first and second lever arms, each said lever arm having a first end and a second end and each said lever arm having clamp engaging jaws at the first end, wherein said clamp engaging jaws are disposed in opposed alignment;

an auxiliary punch having a first end and a second end, said auxiliary punch being positioned for movement approximately perpendicular toward and away from the clamp engaging jaws;

a pair of elongated handles, each said elongated handle having a free end and a connecting end, said connecting end comprising a first pivot point and a second pivot point wherein each of said first pivot points is pivotally attached to the second end of one of said first and second lever arms and each of said second pivot points is pivotally attached together;

a pair of side plates to hold said first and second clamp engaging jaws;

a guide bushing pivotally attached to said side plates, having said auxiliary punch slidably mounted through said guide bushing such that the second end of said auxiliary punch engages the second pivot points of said connecting ends of said elongated handles, wherein operation of said elongated handles following closure of said clamp engaging jaws causes the first end of said auxiliary punch to move toward said clamp engaging jaws after said clamp engaging jaws have engaged and crimped a clamp.

2. The clamp installation tool of claim 1, wherein said first and second clamp engaging jaws are selectively movable between a closed position and an open position.

3. The clamp installation tool of claim 1, further comprising:

a pair of floating disc synchronizers whereby the clamp engaging jaws are maintained in said opposed alignment.

4. The clamp installation tool of claim 3, wherein said auxiliary punch is slidably mounted between said floating disc synchronizers.

5. The clamp installation tool of claim 1, said side plates further comprising portal cutouts.

6. The clamp installation tool of claim 1, said auxiliary punch further comprising a pair of tabs protruding laterally from the side of said auxiliary punch; and said side plates further comprising a slot sized and configured to allow said tabs to slidably engage therein.

7. The clamp installation tool of claim 1, said elongated handles further comprising a releasable latching mechanism.

8. A clamp installation tool, comprising:

first and second lever arms, each said lever arm having a first end and a second end and each said lever arm having clamp engaging jaws at the first end, wherein said clamp engaging jaws are disposed in opposed alignment;

an auxiliary punch having a first end and a second end, said auxiliary punch being positioned for movement approximately perpendicular toward and away from the clamp engaging jaws;

a cam pivotally mounted such that the surface of said cam engages the second end of said auxiliary punch; and a rotatable arm removably attached to said cam, wherein operation of said rotatable arm causes said auxiliary punch to move toward said clamp engaging jaws by engagement of the cam against the second end of the auxiliary punch.

9. The clamp installation tool of claim 8, wherein said first and second clamp engaging jaws are selectively movable between a closed position and an open position.

10. The clamp installation tool of claim 8, further comprising:

a pair of floating disc synchronizers whereby the clamp engaging jaws are maintained in said opposed alignment.

11. The clamp installation tool of claim 10, wherein said auxiliary punch is slidably mounted between said floating disc synchronizers.

12. The clamp installation tool of claim 8, further comprising:

a pair of side plates to hold said first and second clamp engaging jaws.

13. The clamp installation tool of claim 12, said side plates further comprising portal cutouts.

14. The clamp installation tool of claim 12, said auxiliary punch further comprising a pair of tabs protruding laterally from the side of said auxiliary punch; and said side plates further comprising a slot sized and configured to allow said tabs to slidably engage therein.

15. The clamp installation tool of claim 8, further comprising:

a pair of elongated handles, each said elongated handle having a free end and a connecting end, said connecting end comprising a first pivot point and a second pivot point wherein each of said first pivot points is pivotally attached to the second end of one of said first and second lever arms and each of said second pivot points is pivotally attached together.

16. The clamp installation tool of claim 15, said elongated handles further comprising a releasable latching mechanism.

17. A clamp installation tool, comprising:

first and second lever arms having a first end and a second end, each said lever arm having clamp engaging jaws at the first end, said clamp engaging jaws being disposed in opposed alignment, and each said lever arms comprising cam surfaces having a curved portion and a flat portion on the second end;

an auxiliary punch having a first end and a second end, said auxiliary punch being positioned for movement approximately perpendicular toward and away from the clamp engaging jaws; and a ram having at least one roller that engages the cam surface on said lever arms, such that as said ram is extended said at least one roller causes said first and second lever arms to extend laterally and said clamp engaging jaws to translate to a closed position, wherein, after said clamp engaging jaws translate to a closed position, said at least one roller engages the flat portion of said cam surface and the at least one roller on the ram engages the second end of said auxiliary punch, which causes said auxiliary punch to move toward said clamp engaging jaws.

18. The clamp installation tool of claim 17, wherein said ram comprises a hydraulic ram.

19. A clamp installation tool, comprising:

first and second lever arms, each said lever arm having a first end and a second end and each said lever arm having clamp engaging jaws at the first end, wherein said clamp engaging jaws are disposed in opposed alignment;

an auxiliary punch having a first end and a second end, said auxiliary punch being positioned for movement approximately perpendicular toward and away from the clamp engaging jaws;

a cam spade mounted on a jackscrew; and means to rotate said jackscrew, such that rotation of said jackscrew causes said cam spade to extend outward, wherein said cam spade engages the second end of said first and second lever arms causing said first and second lever arms to extend laterally and said clamp engaging jaws to translate to a closed position and wherein, after said clamp engaging jaws translate to a closed position, said cam spade engages the second end of said auxiliary punch, which causes said auxiliary punch to move toward said clamp engaging jaws.

* * * * *